United States Patent [19]

Jones et al.

[11] 4,163,341

[45] Aug. 7, 1979

[54] SLOTLESS STEERING ASSEMBLY

[75] Inventors: Lawrence T. Jones, Playa del Rey; Anson Sims, Northridge; Ashley G. Howden, Los Angeles; Michael J. Geery, Manhattan Beach, all of Calif.

[73] Assignee: California R & D Center, Culver City, Calif.

[21] Appl. No.: 771,937

[22] Filed: Feb. 25, 1977

[51] Int. Cl.[2] ..... A63H 18/12; A63H 18/10

[52] U.S. Cl. ..... 46/262; 46/259; 273/86 B

[58] Field of Search ..... 46/254–262; 273/86 B

[56] References Cited

U.S. PATENT DOCUMENTS

| | | | |
|---|---|---|---|
| 3,205,618 | 9/1965 | Heytow | 46/255 |
| 3,579,906 | 5/1971 | La Forge | 46/258 |
| 3,774,340 | 11/1973 | Barlow et al. | 46/259 |
| 3,926,434 | 12/1975 | Cannon | 46/259 |

*Primary Examiner*—Louis G. Mancene
*Assistant Examiner*—Robert F. Cutting
*Attorney, Agent, or Firm*—Jackson, Jones & Price

[57] ABSTRACT

Miniature vehicles operable on a slotless track have their front wheels disposed on a tie bar assembly mounting a permanent magnet. The permanent magnet is disposed to be attracted to either the right or left pole piece of a solenoid. First and second operator applied steering voltages activate a zener diode to switch current through the solenoid to effect right or left steering and lane changing by the vehicles.

1 Claim, 11 Drawing Figures

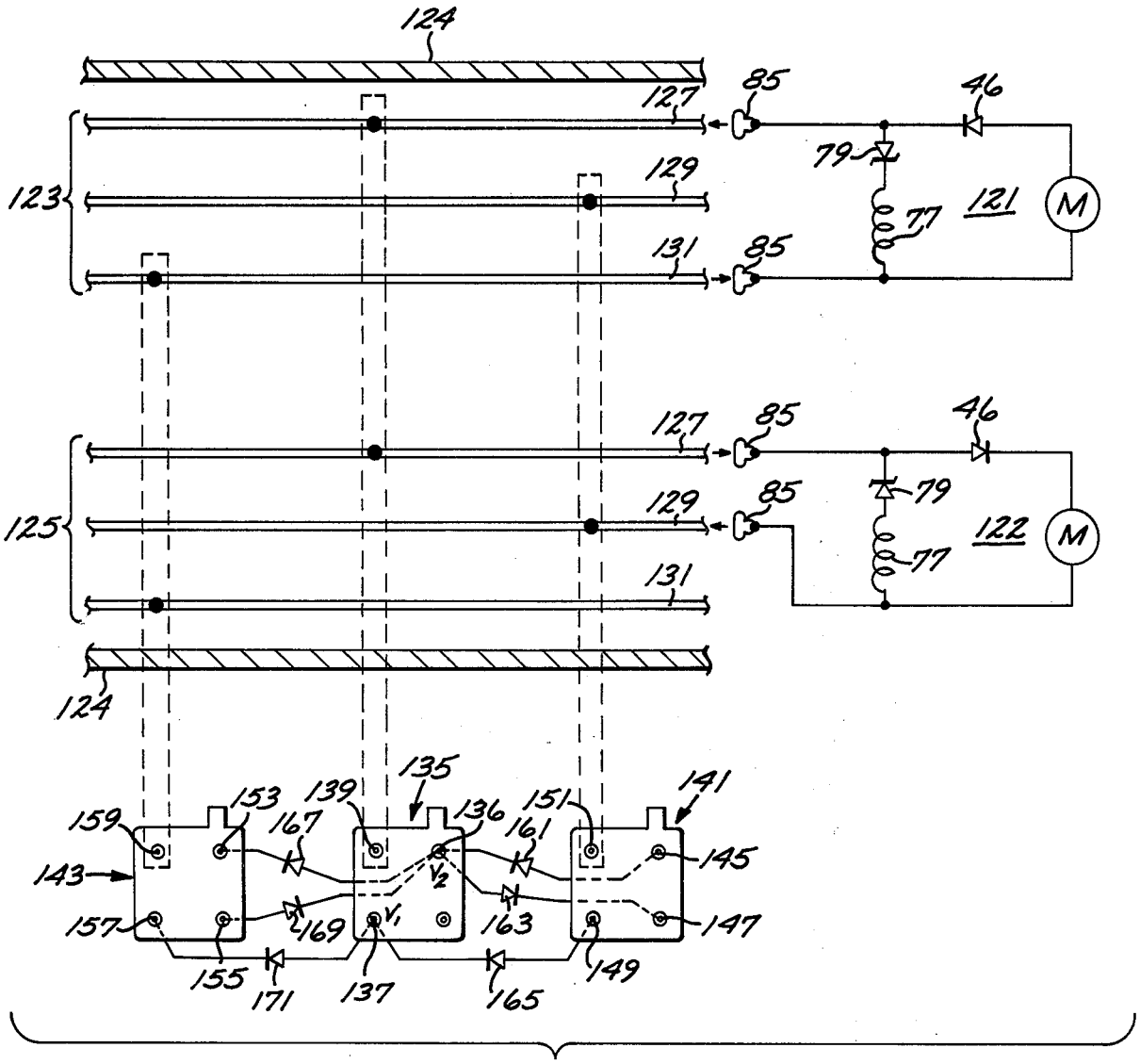
FIG. 9
FIG. 10
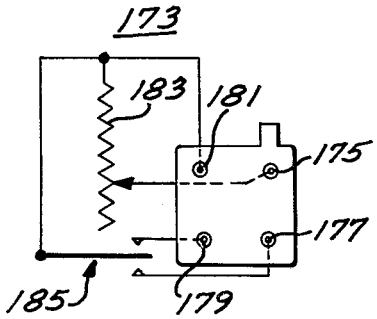
FIG. 11
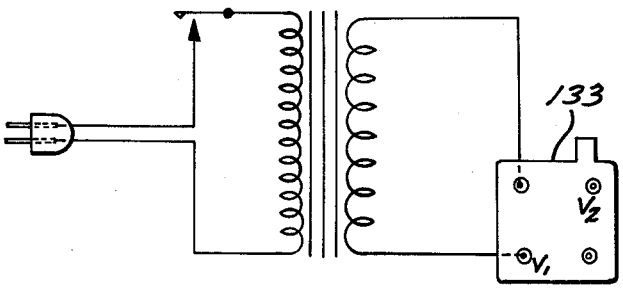

SLOTLESS STEERING ASSEMBLY

BACKGROUND OF THE INVENTION

The subject invention relates generally to toy miniature vehicles and more particularly to miniature vehicles which may be controlled at the will of the operator to turn out and pass one another on a slotless track.

In the prior art, numerous attempts have been made to make toy miniature vehicles more realistic in performance by adding the dimension of steerability to that of speed control. Such attempts are illustrated by Brand el al, U.S. Pat. No. 3,837,286; Barlow et al, U.S. Pat. No. 3,797,404; and Heytow, U.S. Pat. No. 3,205,618. Such attempts have in general involved complex mechanical structure or electrical circuitry to provide the necessary operator control of lane changing and steering. The complexity of the mechanisms of the prior art have often entailed unrealistic vehicle performance and/or appearance. In the miniature vehicle art, simplicity,accompanying low cost and realism have been prime but elusive objectives.

SUMMARY OF THE INVENTION

It is therefore an object of the invention to improve and simplify toy miniature vehicles. It is another object of the invention to provide a simple and effective steering mechanism which will allow toy vehicles to turn out and pass one another. It is yet another object of the invention to provide a simple electromagnetic means for controlling the steering of the front wheels of a miniature vehicle in response to operator signals.

These and other objects and advantages of the invention are accomplished by providing a steering means which is pivotable between first and second positions in response to operator control. More specifically, the steering mechanism includes means responsive to first and second operator control signals to reverse the polarity of a magnetic field. The magnetic field is oriented to control the positioning of the vehicle front wheels between first and second biased positions. A retaining wall along the vehicle path maintains the vehicles in position despite the biasing of the wheels against the line travel of the vehicle.

BRIEF DESCRIPTION OF THE DRAWINGS

The preferred embodiment and best mode for practicing the just summarized invention will now be described in detail in conjunction with the drawings of which:

FIG. 9 is a schematic diagram illustrating the electrical configuration of the car, track and energizing system of the preferred embodiment of the invention.

FIG. 10 illustrates an operator controller according to the preferred embodiment of the invention.

FIG. 11 illustrates a power supply for use with the preferred embodiment of the invention.

DETAILED DESCRIPTION OF THE PREFERRED EMBODIMENT

Figure 1:
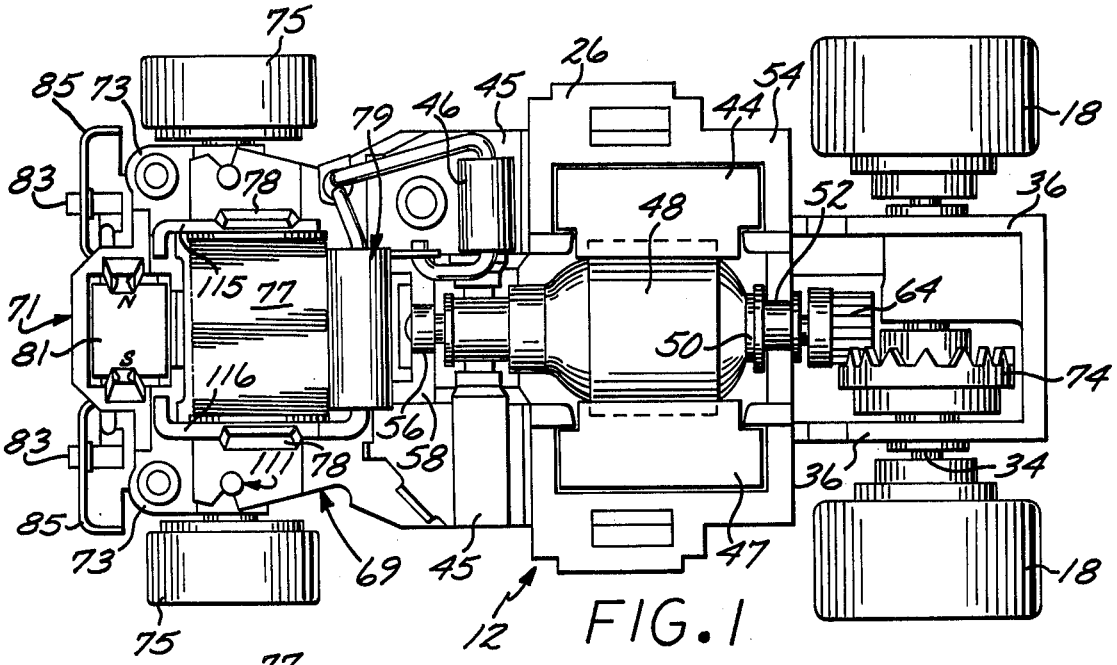
FIG. 1 is a top view of a miniature vehicle configured according to the preferred embodiment of the invention.

Referring now generally to the drawings, there is shown a toy vehicle chassis assembly 12 (FIG. 1). A toy car body of a desired style may be fitted over the chassis assembly 12. The car rides on front wheels 75 and rear wheels 18 on a track, the surface of which is interrupted by electrically conductive rails 127, 129, 131 (FIG. 9). The chassis 12 of the car includes a main frame 26 onto which is mounted the other elements of the chassis assembly 12. In particular the steering mechanism of the preferred embodiment is mounted at the front portion 69 of the chassis frame 26.

The rear wheels 18, which are of a wide configuration and may be covered with foam material having a high coefficient of friction, are mounted on a rear axle 34. The rear axle 34 is journaled in a pair of rearwardly extending bosses 36.

The armature assembly 48 (FIG. 1) and the stationary motor magnets 44, 47 combine to form the main elements of the electric motor which drives the vehicle. The motor magnets 44, 47 may be loosely mounted within the main frame 26 and held by a retaining clip. The motor armature assembly 48 and its armature shaft 50 are mounted for rotational movement in the chassis 12. The rear end of the armature shaft 50 rides in a bearing 52 in a cross member 54 of the main frame 26. The front end of the shaft 50 rides in a bearing opening 56 in a front cross member 58.

The drive train from the vehicle motor extends through the shaft 50 to a pinion gear 64 which is fixed to the shaft 50 outside of the rear cross member 54. The pinion gear 64 engages a crown gear 74 which, in turn, is fixed to and drives the rear axle 34. Thus, upon rotation of the armature 48, the pinion gear 64 is driven at a relatively high speed and that speed is geared down by passage through the crown gear, delivering rotational power to the rear wheels 18.

Suitable brushes 45 provide energy to the armature 48 from first and second pick-up shoes 85. The pick-up shoes 85 are of spring material and are biased to contact the conductive track rails 127, 129, 131. They are attached near the middle of the underside of the chassis 26 and float on tangs 83 at the front of the chassis 26. A diode 46 is connected between one of the pick-up shoes 85 and one of the brushes 45. The function of this diode 46 will be described below.

Figure 2:
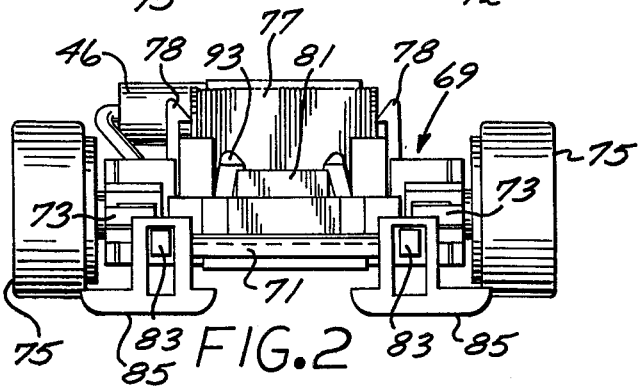
FIG. 2 is a front view of the vehicle of FIG. 1.

The steering mechanism of the present invention is formed at the front 69 of the chassis 26 (FIG. 1, FIG. 2). A tie bar assembly 71 is slidably mounted on the chassis front 69 and is pivotally attached to the chassis by means of two spindles 73. The front wheels 75 are rotatably mounted on the spindles 73 and may be turned in unison by movement of the tie bar assembly 71.

A steering coil assembly 77 is mounted on the top of the chassis front 69 by two mounting clips 78. The coil 77 is supplied with current through a zener diode 79, as will be later detailed, and is arranged to control the position of a permanent magnet 81, which forms part of the tie bar assembly 71.

Figure 3:
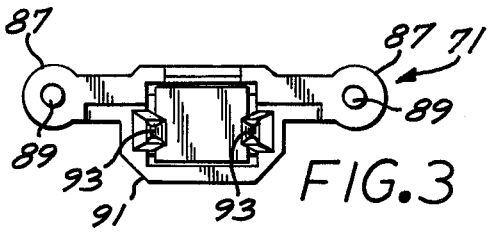
FIG. 3 is a top view of the tie bar assembly of the preferred embodiment of the invention.
Figure 4:
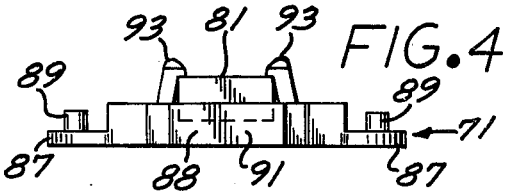
FIG. 4 is an elevation of the tie bar assembly of the preferred embodiment of the invention.

The tie bar assembly 71 is illustrated in more detail in FIGS. 3 and 4. The tie bar assembly 71 includes a tie bar 88 and the magnet 81 mounted therein. The tie bar 88 bears a semicylindrical mounting surface 87 at either end. Each mounting surface 87 supports a pin 89. The tie bar 88 further includes a receptacle 91 and two flexible fingers 93 which retain the magnet 81. As seen in FIG. 3, the receptacle portion extends out away from the tie bar 88 in order to enable the magnet 81 to cooperate with the steering coil assembly 77 of FIG. 1.

Figure 5:
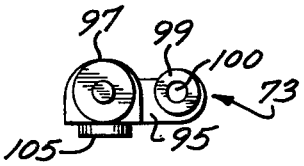
FIG. 5 is a top view of the spindle of the preferred embodiment of the invention.
Figure 6:
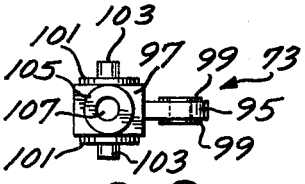
FIG. 6 is a side view of the spindle of the preferred embodiment of the invention.

The tie bar assembly 71 is connected to the chassis front 69 by means of the two spindles 73, one of which is shown in greater detail in FIGS. 5 and 6. Each spindle 73 includes an arm 95 extending from a spindle body 97. The arm 95 bears a slightly raised cylindrical surface 99 on either side thereof through which is bored a hole 100. The spindle base 97 also has raised cylindrical portions 101 on either side thereof and a pin 103 extending from either cylindrical portion 101. The spindle body 97 also bears a hub 105 which has a hole 107 drilled entirely therethrough on an axis perpendicular to that of the pins 103. The spindle body hole 107 is designed to mount one of the front wheels 75, while the spindle arm hole 100 accomodates one of the pins 89 on the tie bar 88.

Figure 7:
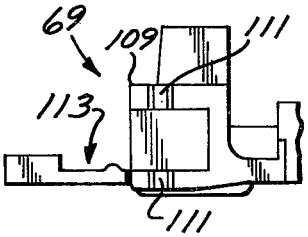
FIG. 7 is a side view of the chassis front of the preferred embodiment of the invention.
Figure 8:
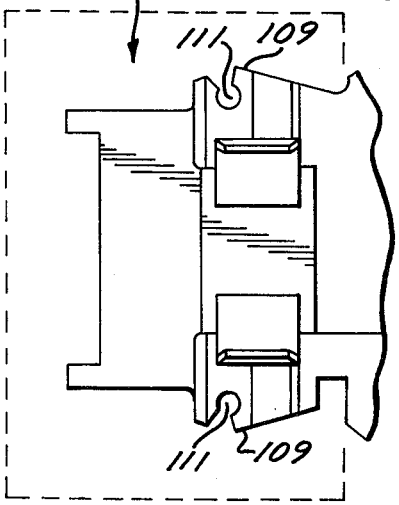
FIG. 8 is a view of the underside of the chassis front of FIG. 7.

As illustrated in FIG. 7, the chassis front 69 has a spindle bearing 109 wherein the spindle body 97 is pivotally mounted. This pivotal mounting is accomplished by snap-fitting the spindle pins 103 into partially open cylindrical apertures 111 in the side of the spindle bearing 109.

In assembly, the tie bar assembly 71 is slidably born by the surface 113 (FIG. 7) of the chassis front 69. The arm 95 of a spindle 73 encompasses each pin 89 on the tie bar 88 while the spindle pins 103 rotate in the spindle bearing 109. Suitable wheels 75 mount through the apertures 107 in the wheel hubs 105 on the spindle bodies 97. In this manner, an articulated steering assembly results, which may pivot the wheels 765 in unison to the right or the left.

In accordance with the preferred embodiment of the invention, the movement or steering of the wheels 75 is controlled by the steering coil assembly 77. This coil assembly 77 includes suitable pole pieces 115, 116 in between which the tie bar magnet 81 partially lies. Proper energization of the coil will attract the tie bar magnet either to the right pole piece 115 or to the left pole piece 116, depending on the polarity of energization.

Once attracted to a pole piece 115, the permanent magnet will remain in contact therewith, holding the wheels in a turned position with respect to the chassis 12. Reversing the magnetic field of the coil will then force the permanent magnet 81 to the other pole piece 116. While it is preferred to mount the permanent magnet on the tie bar, a permanent magnet or magnets could be mounted elsewhere in the vehicle to retain the wheels in a turned position. Only an element responsive to the coil field would then need to be associated with the wheel turning assembly such as the tie bar 81.

Thus, controlling the polarity of energization of the coil will permit controlled steering. The manner in which steering control is accomplished by means of the zener diode 79 and the coil assembly 77 will now be described, considering the electrical schematics of FIG. 9–11.

FIG. 9 illustrates electrical schematics for two cars 121, 122 adapted for operation in a dual car system. Considering one of the cars 121, the electrical circuitry consists of a zener diode 79 having its anode connected to one of the pick-up shoes 85 and its cathode connected to a steering coil 77. The other terminal of the steering coil 77 is connected to the other pick-up shoe 85. Thus, the voltage across the pick-up shoes 85 is applied across the series combination of the zener diode 79 and the coil 77. This voltage is also applied across the series combination of the diode 46 and the vehicle motor. The diode 46 in the first car 121 has its anode connected to one motor terminal and its cathode connected to the anode of the zener diode 79. The diode 46 functions in a two car system to select the polarity of energy which will activate the motor. The zener and coil combination 79, 77 detects application of steering voltage and reacts thereto to steer the car 121 in a selected direction.

The second car 122 is similar in electrical structure to the first car 121, except that the polarity of the diode 46 and zener diode 79 in the second car 122 are reversed in order to adapt the second car 122 to be driven by a voltage of opposite polarity to that driving the first car 121.

The track on which the vehicles 121, 122 operate includes two rail systems 123, 125, each including three rails 127, 129 and 131. One rail 127 is a common or ground rail. A second rail 129 provides a first voltage of a polarity with respect to the common rail necessary to drive the motor of the second car 122, while a third rail 131 provides a second voltage of polarity opposite to the first for driving the first car 121. Each car 121, 122 has one of its pick-up shoes 85 located to contact the common rail 127 of either rail system 123, 125. The first car has its other pick-up shoe 85 located to contact the third rail 131 of either rail system. The second car 122 has its other pick-up shoe 85 located to contact the second rail 129 on either rail system 123, 125. In this manner, either car 121, 122 may be supplied with activating energy by either rail system 123, 125.

On either side of the track is a wall or other retaining surface 124. As will be detailed further below, the vehicle steering mechanism functions such that the vehicle wheels are always canted away from the line of the rails. Therefore the walls 124 serve to maintain each car 121, 122 on the track as it travels forward. The walls 124 are also located so as to properly index each car's pick-up shoes 85 to ride over the appropriate pair of activating rails.

Power to the rail systems 123, 125 is provided by a power and control assembly 123 illustrated in FIGS. 9–11. While the plug-in receptacle structure disclosed is preferred, many other control devices can be configured according to the principles disclosed below without departing from the scope of this invention. A power source receptacle 135 (FIG. 9) is supplied with first and second alternating voltages $V_1$ and $V_2$ by a conventional power supply (FIG. 11). For example, the first voltage $V_1$ may be on the order of 30 volts rms while the second voltage $V_2$ is on the order of 13 volts rms. The second voltage $V_2$ is applied to a first terminal 136, while the higher voltage $V_1$ is applied to a second terminal 137. Preferably, the power supply receptacle 133 plugs into the power source receptacle 135. A common terminal 139 of the power source receptacle 135 connects to the common track rails 127.

Power is supplied from the power source receptacle 135 to first and second control receptacles 141 and 143. The first control receptacle includes four terminal plugs 145, 147, 149, 151. The second receptacle 143 also contains four terminal plugs 153, 155, 157, 159. These terminal plugs provide interconnections between the power source receptacle 135 and control receptacles 141, 143 and are adapted to receive a controller 173 (FIG. 10).

The first control receptacle 141 is connected via three diodes 161, 163, 165 to the power source receptacle 135. A first diode 161 has its anode connected to the terminal 145 and its cathode connected to the terminal 136. A second diode 163 has its anode connected to the terminal 136 and its cathode connected to the terminal 147. The third diode has its anode connected to the terminal 149 and its cathode connected to the terminal 137.

Similarly, three diodes 167, 169, 171 connect the second control receptacle 153 to the power source receptacle 135. A first diode 167 has its anode connected to the terminal 136 and its cathode connected to the terminal 153. A second diode has its anode 169 connected to the terminal 155 and its cathode connected to the terminal 136. A third diode has its anode connected to the terminal 137 and its cathode connected to the terminal 157.

The diodes connecting each receptacle 141, 143 insure generation of the proper polarity voltage to accomplish the motor driving and steering switching functions for each car 121, 122. These voltages are delivered from respective control receptacle terminals 159, 151 to energize the drive rails 131, 129 of the rail systems 123, 125.

The proper selection of driving and steering functions is enabled by a controller 173, one of which connects to each control receptacle 141, 143. As illustrated in FIG. 10, the controller 173 includes four contact terminals 175, 177, 179, 181; a variable resistor or rheostat controller 183 and a normally open, three position switch 185. The four controller terminals 175, 177, 179, 181 are adapted to plug respectively into the four control receptacle terminals, (for example 145, 147, 149, 151) of either receptacle 141, 143. The first controller terminal 181 is connected to one terminal of the resistive rheostat element 183 and to the switch 185. The second controller terminal 175 is supplied with the second voltage $V_2$ through a diode from the power source terminal 136 and is connected to the other terminal of the rheostat control 183. The other two controller terminals 179, 177 are connected such that the switch element 185 may contact either terminal 177, 179, applying a component of the first voltage $V_1$ or of the second voltage $V_2$ to the rail.

In operation, one of the cars, for example the first car 121, is controlled via a controller 173 plugged into a control receptacle 143. Normally the rheostat control 183 varies the proportion of the second voltage $V_2$ supplied to the first car 121. The diode 167 assures that the proper (positive) polarity is applied to drive the motor of the first car 121.

When it is desired to change lanes, the switch 185 is turned in the direction of the lane change desired. The rheostat 183 is bypassed and a switching voltage is applied directly across the zener diode 79. For the first car 121, this switching voltage is the negative polarity of the second voltage $V_2$ supplied by the diode 169 or the positive polarity of the first voltage $V_1$ supplied by the diode 171.

Application of the appropriate switching voltage causes the zener 79 to switch polarities and reverse the current through the coil 77. This reversal attracts the tie bar magnet 81 to the opposite pole piece 115, 116 effecting a steering action. When the switch 185 is in its center position, the zener circuit is effectively deactivated. However, the permanent tie bar magnet 81 remains attracted to the pole piece, retaining the wheels in a canted or turning position. Thus, the car 121 will change to a new lane and ride against the wall 124 adjacent the new lane. If it is desired to change lanes again, the steering switch is turned to the opposite contact point, activating the zener diode 79 to cause current flow in the opposite direction through the coil. The permanent magnet 81 is then attracted to the opposite pole piece, turning the wheels toward the other wall and effecting the desired lane change.

The second car 122 may be identically controlled. Of course, to provide selective control of lane changing and driving for both vehicles, the second vehicle 122 is supplied with power and control signals opposite in polarity to those supplied to the first car 121. The polarity of these signals is controlled by the diodes 161, 163, 165 connecting the control receptacle 141 and supply receptacle 135.

In summary, a very simple and effective method for effecting realistic lane changing by a miniature vehicle has been disclosed. Many modifications and adaptations of the circuitry and mechanical structure of the just described preferred embodiment may be made without departing from the scope and spirit of the invention. Therefore, it is to be understood that, within the scope of the appended claims, the invention may be practiced other than as specifically described below.

What is claimed is:

1. Miniature vehicle toy apparatus comprising:

a first means for providing a first energizing path adapted to be supplied with a vehicle driving signal and first and second selectively applicable turning control signals, said first means comprising a first lane of travel for said miniature vehicle;

second means for providing a second energizing path adapted to be supplied with said vehicle driving signal and said first and second turning control signals, said second means comprising a second lane of travel for said miniature vehicle;

a miniature vehicle adapted to be driven by said driving signal and having a pivotable steering means;

a coil means in said miniature vehicle for generating a magnetic field;

means for switching a first current of a first polarity through said coil means in response to application of said first control signal and for switching a second current of a second polarity through said coil means in response to said second control signal including at least a diode and a Zener diode;

means connected to said steering means and responsive to the magnetic field created by said first current for positioning said steering means in a first position to effect a change from said first lane to said second lane and responsive to the magnetic field created by said second current for positioning said steering means in a second position to effect a change from said second lane to said first lane;

means for biasing said wheels including a movable permanent magnet and a pair of pole pieces, a first pole piece providing a first steering position after an application of said first current and movement of the magnet toward the first pole piece and a second pole piece providing a second steering position after application of said second current and movement of the magnet toward the second pole piece, the permanent magnet remaining in contact with its respective pole piece to hold the wheels in the desired steering position.

* * * * *

UNITED STATES PATENT AND TRADEMARK OFFICE

CERTIFICATE OF CORRECTION

PATENT NO. : 4,163,341

DATED : August 7, 1979

INVENTOR(S) : Lawrence T. Jones et al

It is certified that error appears in the above-identified patent and that said Letters Patent are hereby corrected as shown below:

Column 1, line 56, after "FIG 1.", "FIG 3" should begin a new paragraph.

Column 3, line 39, delete "765" and insert --75--.

Signed and Sealed this

*Fourth* Day of *December 1979*

[SEAL]

*Attest:*

SIDNEY A. DIAMOND

*Attesting Officer*

*Commissioner of Patents and Trademarks*